US011720058B2

(12) United States Patent
Nojima et al.

(10) Patent No.: US 11,720,058 B2
(45) Date of Patent: Aug. 8, 2023

(54) IMAGE FORMING APPARATUS HAVING AIR EXHAUST SYSTEM FOR FIRST AND SECOND CONNECTED HOUSINGS

(71) Applicant: CANON KABUSHIKI KAISHA, Tokyo (JP)

(72) Inventors: Hiroshi Nojima, Chiba (JP); Keiko Fujita, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,460

(22) Filed: Dec. 7, 2021

(65) Prior Publication Data

US 2022/0187763 A1 Jun. 16, 2022

(30) Foreign Application Priority Data

Dec. 14, 2020 (JP) ..... 2020-207101

(51) Int. Cl.

| | |
|---|---|
| ***G03G 21/00*** | (2006.01) |
| ***G03G 21/20*** | (2006.01) |
| ***G03G 15/00*** | (2006.01) |
| *G03G 15/20* | (2006.01) |

(52) U.S. Cl.

CPC ..... *G03G 21/206* (2013.01); *G03G 15/657* (2013.01); *G03G 15/2017* (2013.01); *G03G 2221/1645* (2013.01)

(58) Field of Classification Search

CPC ..... G03G 15/657; G03G 21/206; G03G 2221/1645

USPC ..... 399/92, 93, 305

See application file for complete search history.

(56) References Cited

U.S. PATENT DOCUMENTS

| | | | | |
|---|---|---|---|---|
| 4,530,589 | A * | 7/1985 | Adams | G03G 15/04 399/92 |
| 5,038,170 | A * | 8/1991 | Serita | G03G 21/206 399/92 |
| 5,307,132 | A * | 4/1994 | Tsuchiya | G03G 15/2003 399/92 |
| 6,308,026 | B1 * | 10/2001 | Kouchi | G03G 15/00 399/92 |
| 2006/0284960 | A1 * | 12/2006 | Kishi | G03G 21/206 347/140 |
| 2022/0187762 | A1 * | 6/2022 | Fujita | G03G 21/206 |

FOREIGN PATENT DOCUMENTS

JP H07271272 A 10/1995

* cited by examiner

*Primary Examiner* — Robert B Beatty

(74) *Attorney, Agent, or Firm* — Canon U.S.A., Inc. I.P. Division

(57) ABSTRACT

An image forming apparatus includes a first housing inside an image forming unit, a second housing that includes a fixing unit, a conveyance belt provided in the first housing to convey a sheet, first and second intake fans, and first and second duct units. The first intake fan takes in air to suction the sheet to an outer peripheral surface of the conveyance belt. The first duct unit provided in the first housing forms an air path for exhausting air from the first intake fan. The second intake fan provided in the second housing takes in air near the fixing unit. The second duct unit provided in the second housing passes air flowing in from the first duct unit and the air taken in by the second intake fan. The second duct unit includes an exhaust port for exhausting air outside and a filter through which the exhausted air passes.

6 Claims, 11 Drawing Sheets

FIG.4
FIG.4A FIG.4B
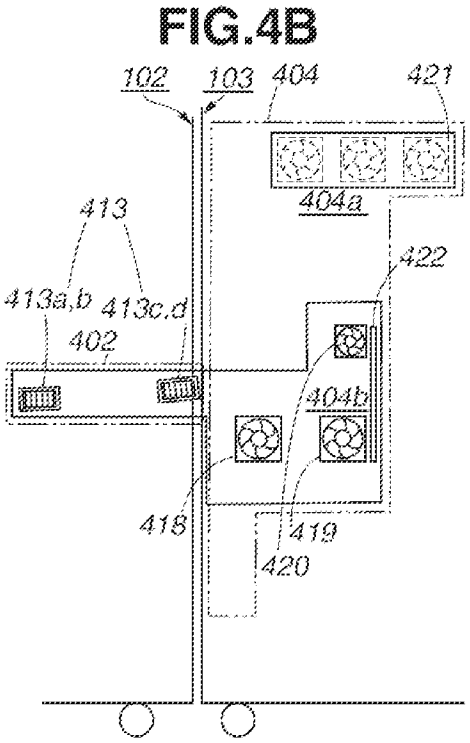
FIG.4B
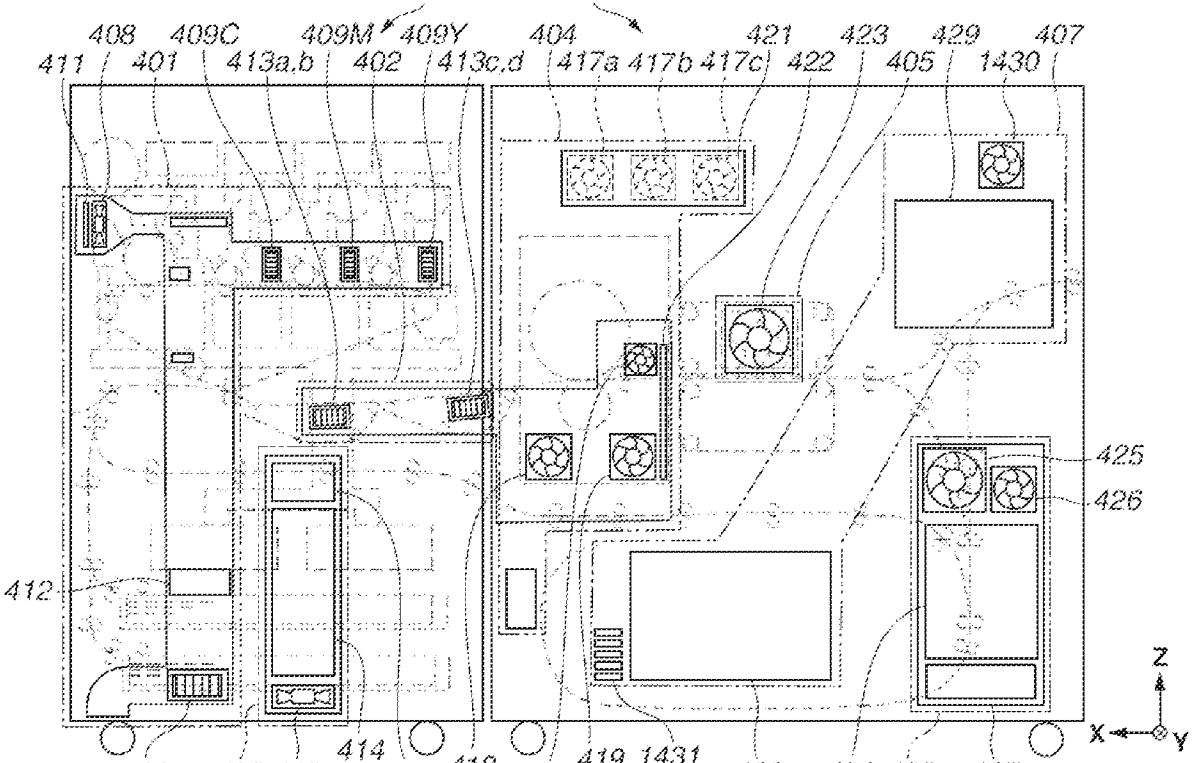
FIG.4A

IMAGE FORMING APPARATUS HAVING AIR EXHAUST SYSTEM FOR FIRST AND SECOND CONNECTED HOUSINGS

BACKGROUND

Field

The present disclosure relates to an electrophotographic image forming apparatus such as a copying machine, a printer, a facsimile machine, and a multifunction peripheral having a plurality of these functions.

Description of the Related Art

In a conventional image forming apparatus, various units provided inside the image forming apparatus, such as an image forming unit that forms a toner image, a fixing unit that heats and fixes toner to a sheet, and a power supply unit that supplies power to the entire apparatus, may generate heat as the image forming apparatus operates. With this reason, a configuration is generally used in which an air blowing fan is provided to form an airflow and exhaust the heat of each unit by exhausting the air taken in from each unit to the outside of the apparatus through an exhaust port.

In this configuration, ozone, dust, volatile organic compounds (VOCs), ultra fine particles (UFPs), and the like may be generated in the vicinity of the image forming unit where the toner image is formed and the fixing unit where the toner is heated.

Thus, Japanese Patent Application Laid-Open No. 7-271272 discusses a configuration in which a collection filter is disposed in an airflow path for exhausting air taken in from an image forming unit or a fixing unit, and the cleaned air is exhausted from an exhaust port to the outside of an apparatus.

In these days, in an electrophotographic image forming apparatus, which has spread from office to commercial printing, there is a tendency for the apparatus to become larger as a result of higher productivity, higher image quality, higher stability, longer life, and higher functionality. The larger the device is, the more difficult to move the image forming apparatus is during manufacturing and installation indoors.

Thus, in a recent image forming apparatus for commercial printing, an image forming apparatus including a plurality of housings has been proposed, for example, adopting a configuration where the housings are divided into a housing having a transfer unit transferring a toner image onto a sheet and a housing having a fixing unit fixing the toner image transferred onto the sheet.

On the other hand, in the fixing unit, a phenomenon is known in which the above-described VOCs, UFPs, and the like is retained on the upstream side of the fixing nip of the fixing unit in a sheet conveyance direction.

Thus, in a case where the fixing unit is provided on the downstream side in the sheet conveyance direction in any of the plurality of housings, it is necessary to also provide an airflow for collecting VOCs and UFPs in a housing disposed on the upstream side of the housing where the fixing unit is provided.

As a result, in an image forming apparatus including a plurality of housings, an airflow for exhausting air in the vicinity of the fixing unit have to be provided for each of the plurality of housings. In this case, a collection filter must be provided for each of the plurality of airflows, which may reduce the workability during maintenance such as a filter replacement.

SUMMARY

The present disclosure is directed to an image forming apparatus including a plurality of housings, capable of improving maintainability at the time of filter replacement.

According to an aspect of the present disclosure, an image forming apparatus, including a first housing inside an image forming unit configured to form a toner image on a sheet and a second housing provided on a downstream side with respect to the first housing in a sheet conveyance direction and including a fixing unit configured to fix the toner image formed by the image forming unit to the sheet, includes a conveyance belt provided in the first housing and configured to convey the sheet on which the toner image formed by the image forming unit to the fixing unit, a first intake fan configured to take in air so as to suction the sheet to an outer peripheral surface of the conveyance belt, a first duct unit provided in the first housing and configured to form an air path for exhausting air that is taken in by the first intake fan, a second intake fan provided in the second housing and configured to take in air in a vicinity of the fixing unit, and a second duct unit provided in the second housing and configured to pass through the air flowing in from the first duct unit and the air taken in by the second intake fan, wherein the second duct unit includes an exhaust port for exhausting the air in the second duct unit to an outside of the image forming apparatus and a filter through which the air exhausted from the exhaust port to the outside of the image forming apparatus passes.

Further features of the present disclosure will become apparent from the following description of exemplary embodiments with reference to the attached drawings.

BRIEF DESCRIPTION OF THE DRAWINGS

FIG. 4, which includes FIG. 4A and FIG. 4B, is a rear view of an airflow arrangement of the image forming apparatus.

DESCRIPTION OF THE EMBODIMENTS

Embodiments of the present disclosure will be described with reference to the accompanying drawings. Note that, the dimensions, materials, shapes, relative arrangements thereof, and the like of the components described in the following exemplary embodiments should be appropriately changed depending on the configuration of the apparatus to which the present disclosure is applied and various conditions, and are not intended to limit the scope of the present disclosure thereto.

<Image Forming System>

Figure 1:
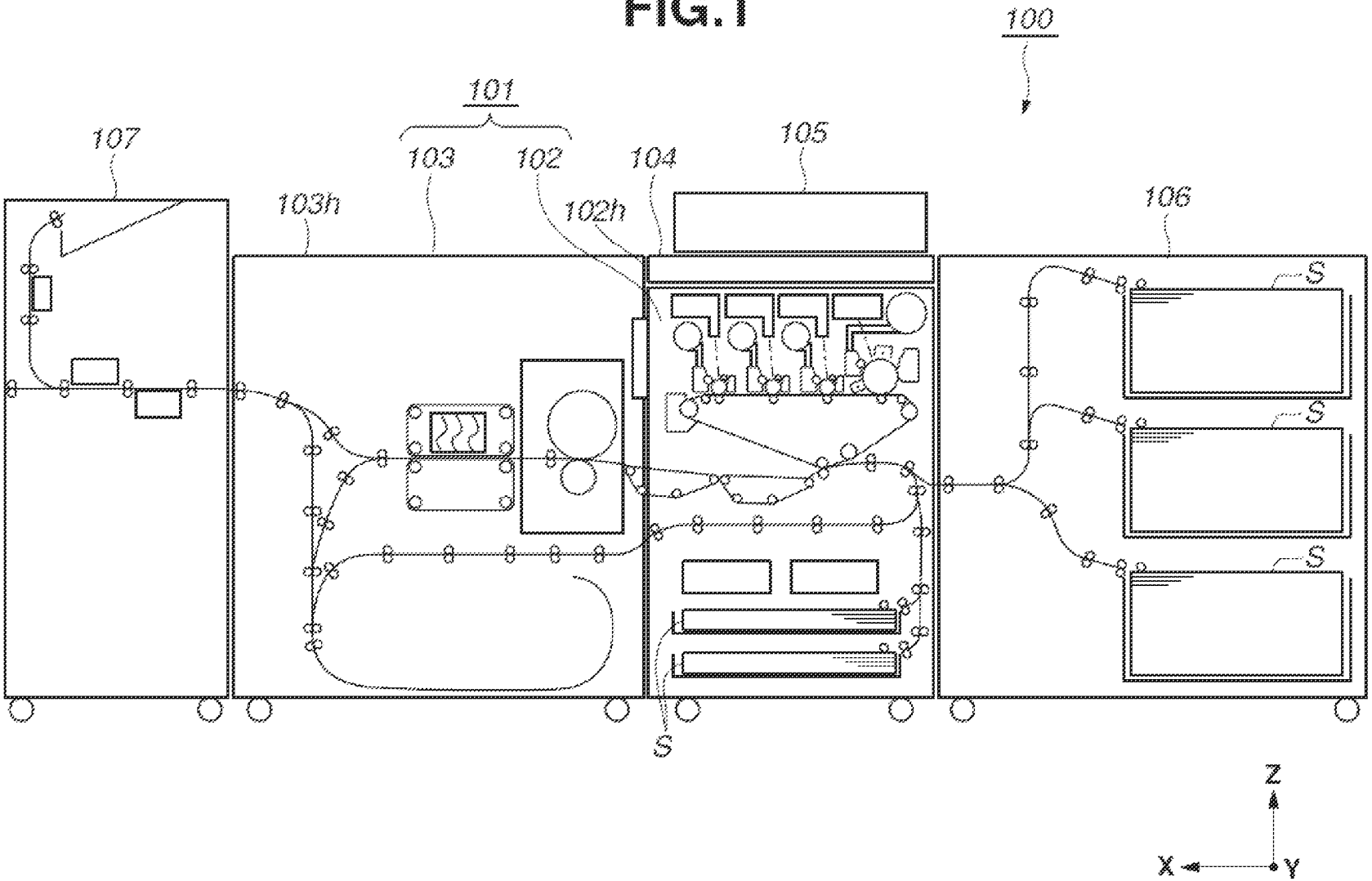
FIG. 1 is a schematic cross-sectional view of an image forming system including an image forming apparatus.

FIG. 1 is a schematic cross-sectional view of an image forming system 100 including an image forming apparatus 101 according to a first exemplary embodiment. The image forming apparatus 101 illustrated in FIG. 1 includes an image forming unit 102 that transfers a toner image onto a fed sheet S, and a fixing conveyance unit 103 that fixes the transferred toner image onto the sheet S. The image forming unit 102 has a housing 102*h* and the fixing conveyance unit 103 has a housing 103*h*, where each housing is independent and can be moved with a plurality of casters provided in each of them. This configuration makes it possible to pack and transport even a large apparatus in a state where each unit is separated in a housing, thereby improving workability during distribution up to installation.

A document reading device 104 for reading a document image and a document feeding device 105 for feeding a plurality of loaded documents one by one to the document reading device 104 are selectively connected to the upper part of the image forming unit 102.

Any of a high-capacity feed device 106 having a plurality of sheet storage units, a manual feed device (not illustrated), or a long feed device (not illustrated) capable of storing a long sheet can be selectively connected on the upstream side of the image forming unit 102 in the sheet conveyance direction. Any of a high-capacity feed device, a manual feed device, or a long feed device (not illustrated) can be selectively connected on the further upstream side of the high-capacity feed device 106 in an overlapping manner.

Selectively connected to the downstream side in the sheet conveyance direction of the fixing conveyance unit 103 is a sensing device 107 for reading the toner image(s) after fixing formed on one or both sides of the sheet S, detecting the image density and image position displacement, and performing feedback correction on the image signal transmitted to the image forming unit 102.

One or more combinations of various sheet processing devices (not illustrated), such as an inserter, a puncher, a case binding machine, a large capacity stacker, a folding machine, a finisher, and a trimmer, can be selectively connected on the further downstream side of the fixing conveyance unit 103 or the sensing device 107.

As described above, the image forming apparatus 101 according to the present exemplary embodiment can selectively connect various optional devices upstream and downstream of the sheet conveyance direction to thereby enable in-line output of deliverables with various post-processing processes for various materials, and can provide an image forming system 100 that excels in high productivity, high image quality, high stability, and high functionality. In the present exemplary embodiment, an arrow X direction illustrated in the figures is the width direction (right-left direction) of the image forming system 100, an arrow Y direction is the front-rear direction, and an arrow Z direction is the vertical direction (up-down direction).

<Image Forming Apparatus: Image Forming unit 102>

Figure 2B:
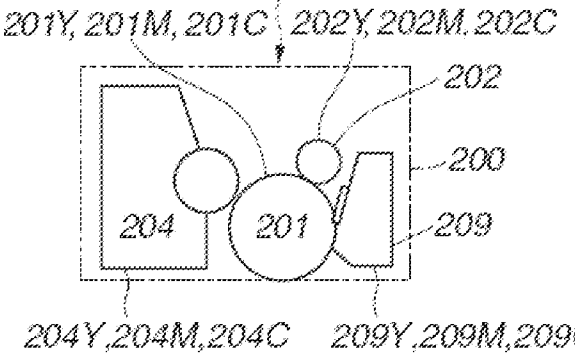
FIGS. 2A, 2B, and 2C are schematic cross-sectional views of an image forming unit of the image forming apparatus.
Figure 2C:
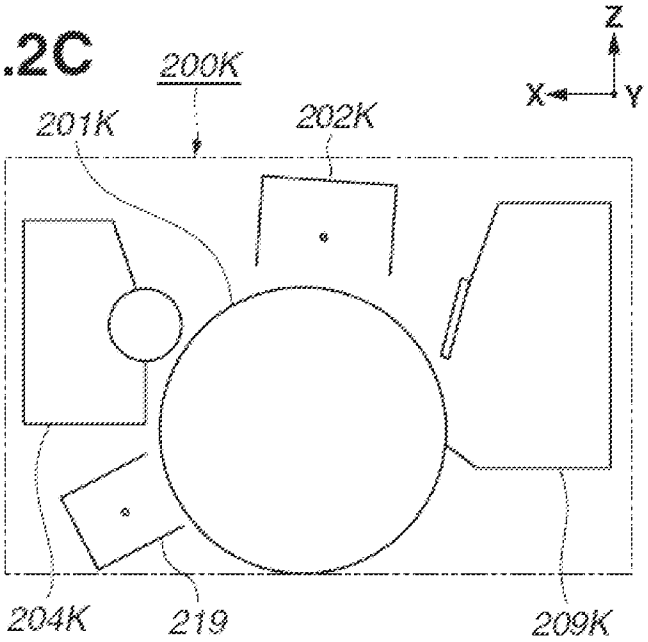
Figure 2A:
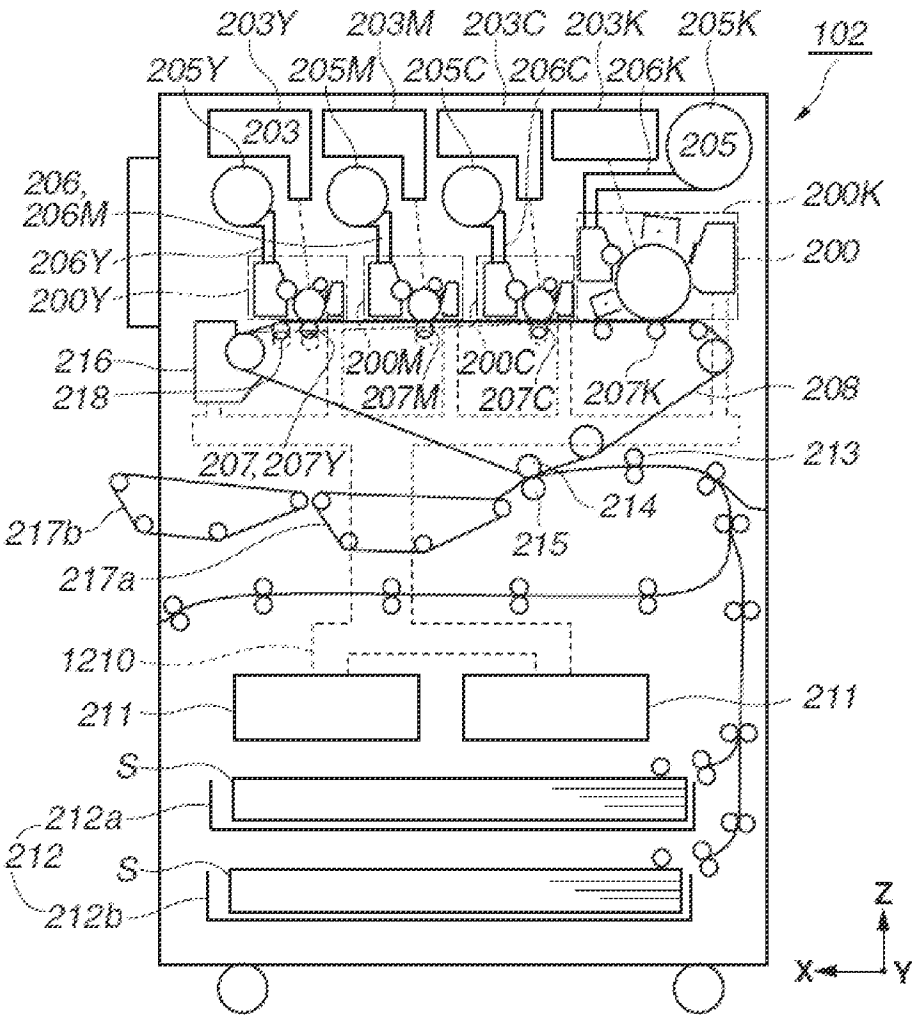

FIGS. 2A, 2B, and 2C are schematic cross-sectional views of the image forming unit 102 of the image forming apparatus 101 according to the present exemplary embodiment. The image forming unit 102 illustrated in FIGS. 2A, 2B, and 2C includes a plurality of image forming stations 200 that form different toner images for different colors of yellow (Y), magenta (M), cyan (C), and black (K). FIG. 2A is a schematic cross-sectional view of the entire image forming unit 102. FIG. 2B is a schematic cross-sectional view of the image forming stations 200Y, 200M, and 200C. FIG. 2C is a schematic cross-sectional view of the image forming station 200K.

As illustrated in FIG. 2A, a photosensitive drum 201 in each image forming station 200 is uniformly charged on its surface by a primary charging device 202, and then an electrostatic latent image is formed by a laser scanner 203 driven on the basis of a transmitted image information signal. The latent image formed at this time is developed as a toner image by a developing device 204. The photosensitive drum 201 according to the present exemplary embodiment is an example of a photosensitive member, the laser scanner 203 is an example of an exposure unit, and the developing device 204 is an example of a developing unit.

Then, the toner consumed by the development is replenished from a toner bottle 205 to each developing device 204 as appropriate via a toner replenishment path 206. Each image forming station 200Y, 200M, and 200C differs only in the color of the toner used, and all the configurations are the same. In the following description, the reference symbols Y, M, C, and K are omitted in the description of the common configurations. Since the image forming station 200K is configured to have some functions different from the functions of the image forming stations 200Y, 200M and 200C, the different parts will be described below.

The toner image on the photosensitive drum 201 is sequentially transferred onto an intermediate transfer belt 208 by applying a predetermined pressure and an electrostatic load bias by a primary transfer roller 207. At this time, the image forming station 200 and the intermediate transfer belt 208 according to the present exemplary embodiment are examples of the image forming unit. A small amount of residual toner remaining on the photosensitive drum 201 after transferring is removed by a photosensitive drum cleaner 209 to prepare for the next image formation. The removed residual toner is stored in a recovered toner container 211 via a toner recovery path 1210. Here, the photosensitive drum cleaner 209 is an example of a cleaning unit for cleaning residual toner in the photosensitive drum 201, and the recovered toner container 211 is an example of a recovery unit.

On the other hand, the sheet S fed one by one by the sheet storage unit 212, having a sheet storage unit 212*a* and a sheet storage unit 212*b*, inside the image forming unit 102 or by any of the paper feed devices connected to the outside of the image forming apparatus 101 as described above is corrected for skewing by forming a loop with the tip of the sheet S following the nip section of a registration roller 213. After that, the registration roller 213 conveys the sheet S to a secondary transfer portion in synchronization with the toner image on the intermediate transfer belt 208.

The toner image on the intermediate transfer belt 208 is transferred to the sheet S by applying a predetermined pressure and an electrostatic load bias at a secondary transfer nip including a secondary transfer inner roller 214 and a secondary transfer outer roller 215. A small amount of residual toner remaining on the intermediate transfer belt 208 after transferring is removed by an intermediate transfer belt cleaner 216 to prepare for the next image formation. The removed residual toner is stored in the recovered toner container 211 via the toner recovery path 1210. The sheet S on which the toner image has been transferred is conveyed by the pre-fixing conveyance belts 217*a* and 217*b* to the downstream fixing conveyance unit 103.

<Image Forming Apparatus: Black-and-White Image Forming>

The image forming apparatus 101 according to the present exemplary embodiment can perform full color image formation using all of the above-described Y, M, C, and K image forming stations 200, and in addition, black-and-white image formation using only the K image forming station 200K.

When a black-and-white image is formed, the primary transfer rollers 207Y, 207, M, and 207C, a primary transfer auxiliary roller 218, and the intermediate transfer belt 208 are displaced to the position indicated by the dashed line in FIG. 2A by a separation mechanism (not illustrated). With this separation mechanism, the Y, M, and C image forming stations 200Y, 200M, and 200C, which now are separated from the intermediate transfer belt 208, can stop their rotational drive. As a result, unnecessary wear of parts caused by unnecessary rotational drive can be prevented in the Y, M, and C image forming stations 200Y, 200M, and 200C, thereby prolonging the life.

On the other hand, the photosensitive drum 201K is configured with a larger diameter suitable for a prolonged life than the diameters of photosensitive drums 201Y, 201M, and 201C. In addition, as illustrated in FIG. 2C, a primary charging device 202K is configured by a non-contact method using a corona charging device that is more suitable for a long life than a contact method using a roller charging device of primary charging devices 202Y, 202M, and 202C. Further, the toner bottle 205K is configured with a larger capacity suitable for a long life than the capacity of the toner bottles 205Y, 205M, and 205C.

With the above-described configuration, even for a user who frequently performs black-and-white image formation, it is possible to prevent the maintenance interval of the K image forming station 200K, which is more frequently used, from being shorter than the maintenance interval of the Y, M, and C image forming stations 200Y, 200M, and 200C, which are less frequently used.

In addition, the large-diameter drum configuration using the primary charging device (corona charging device) 202K has a wider charging width and is more suitable for high-speed operation than the small-diameter drum configuration using the primary charging devices (roller charging devices) 202Y, 202M, and 202C, and thus it is also possible to improve productivity in black-and-white image formation.

In the image forming unit 102 in which the image forming stations 200 have such different conditions from each other, the toner charge amount on the photosensitive drum 201 may differ due to differences in shape and wear. If there is a difference in the toner charge amount, the toner image may not be transferred to the sheet S evenly in the secondary transfer process, resulting in image defects. Accordingly, the K photosensitive drum 201K is provided with a pre-transfer charging device 219 including a corona charging device for leveling the toner charge amount of the photosensitive drum 201K with the toner charge amount of the Y, M, and C photosensitive drums 201Y, 201M, and 201C. In the present exemplary embodiment, the pre-transfer charging device 219 is an example of another charging unit provided between the developing device 204K and the photosensitive drum cleaner 209K in the rotational direction of the photosensitive drum 201.

As described above, the configuration according to the present exemplary embodiment can provide an image forming apparatus 101 that excels in high productivity, high image quality, high stability, and long life, not only in full color image formation but also in black-and-white image formation.

<Image Forming Apparatus: Fixing Conveyance Unit 103>

Figure 3:
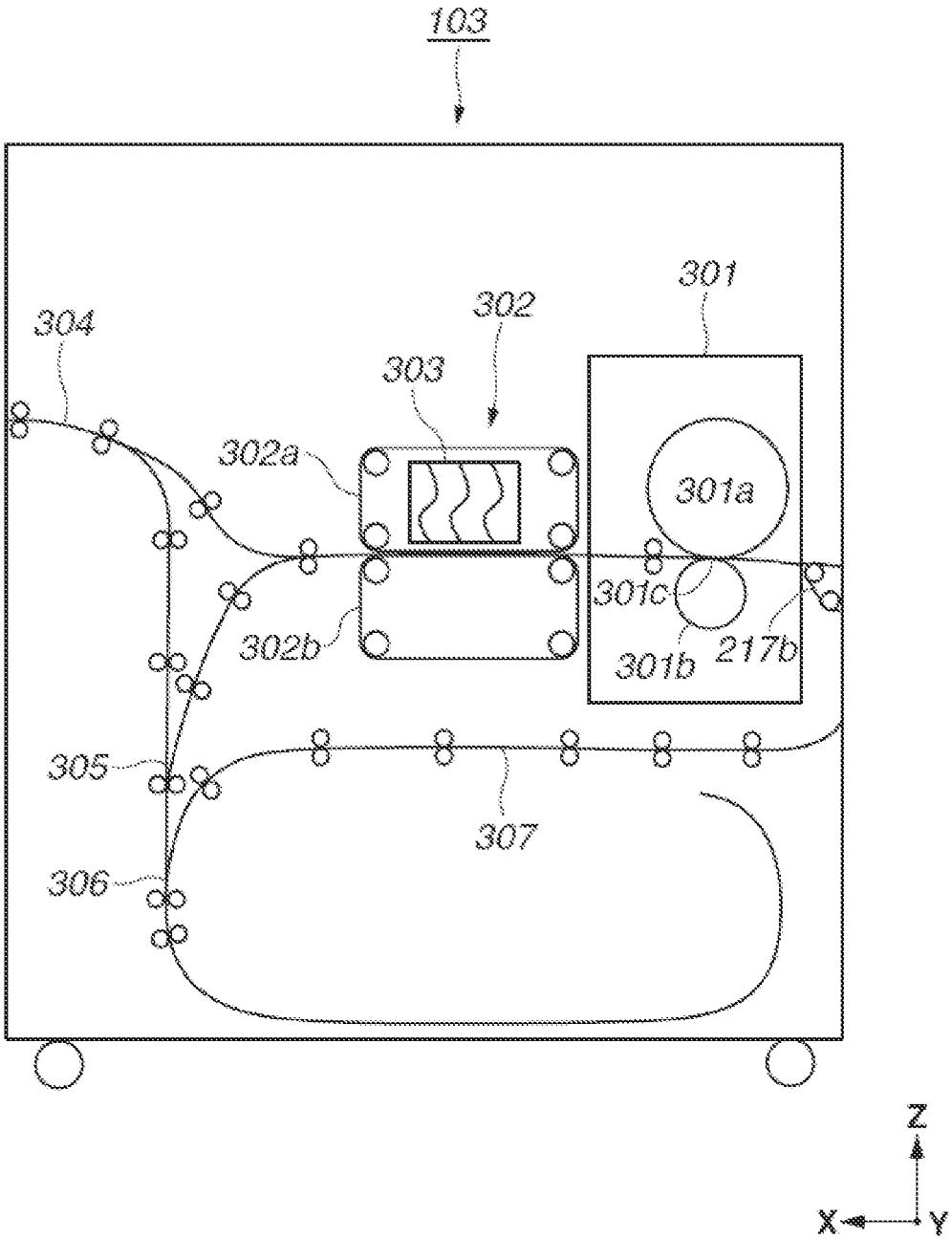
FIG. 3 is a schematic cross-sectional view of a fixing conveyance unit of the image forming apparatus.

FIG. 3 is a schematic cross-sectional view of the fixing conveyance unit 103 of the image forming apparatus 101 according to the present exemplary embodiment. The fixing unit 301 illustrated in FIG. 3 fixes a toner image on the sheet S conveyed from the image forming unit 102 onto the sheet S by heating and pressurizing the toner image.

In the present exemplary embodiment, the fixing unit 301 has a heating roller 301*a* heated by a heater (not illustrated), on the vertically upward side of the fixing unit 301, and has, on the vertically downward side, a pressure roller 301*b* for pressing the sheet S against the heating roller 301*a*. The sheet S on which the toner image has been formed is heated and pressurized at a fixing nip 301*c* formed by the heating roller 301*a* and the pressure roller 301*b* to fix the toner image. Then, the heating roller 301*a* and the pressure roller 301*b* sandwich and convey the sheet S to the downstream side in the sheet conveyance direction while heating and pressurizing the sheet S. In this case, the fixing unit 301 including a pair of rollers 301*a* and 301*b* is described as an example, but a fixing unit 301 forming a fixing nip by a conveyance belt may be used.

The sheet S heated by the fixing unit 301 is conveyed by conveyance belts 302*a* and 302*b* while being cooled by heat absorption of a heat sink 303, of a cooling unit 302, contacting the inner surface of a conveyance belt 302*a*, and is discharged to the above-described sensing device 107 or a post-processing apparatus (not illustrated) via a paper discharge conveyance path 304.

When the front and back of the sheet S are reversed and discharged, switchback conveyance is performed in a paper discharge reversing unit 305, and the sheet S is discharged via the paper discharge conveyance path 304 in a state where the leading and trailing ends of the sheet S are switched and the front surface and back surface are reversed.

In a case where image formation is performed on both sides of the sheet S, the sheet S on which the image of the first side has been formed is conveyed to a duplex conveyance path 307 by performing switchback conveyance in a duplex reverse unit 306, switching the leading and trailing ends of the sheet S and reversing the front and back sides. Then, the sheet S is sent to the registration roller 213 matching the timing with a subsequent sheet S fed by the sheet storage unit 212 inside the image forming unit 102 or by any of the above-described externally connected paper feed devices, and image formation is performed for the second side in the same process as for the first side, and the sheet S is discharged through the paper discharge conveyance path 304.

<Image Forming Apparatus: Airflow Arrangement>

FIG. 4, which includes FIG. 4A and FIG. 4B, is a diagram illustrating an airflow arrangement in the image forming apparatus 101 according to the present exemplary embodiment, and is a view of the image forming apparatus 101, as seen from the rear side. In the present exemplary embodiment, the front side of the image forming apparatus 101 is the side from which the sheet storage unit 212 is pulled out with respect to the image forming apparatus 101, when, for example, replenishing sheets in the sheet storage unit 212, and is the position where a user operating the image forming apparatus 101 stands. In addition, the rear side of the image forming apparatus 101 is the side opposite to the front side in the front-rear direction (insertion/removal direction of the sheet storage unit 212).

As illustrated in FIG. 4A, the image forming unit 102 includes an image formation airflow 401, a pre-fixing conveyance airflow 402, and a power supply airflow 403. The fixing conveyance unit 103 includes a fixing airflow 404, a cooling unit airflow 405, a power supply airflow 406, and an electrical component airflow 407.

For the image formation airflow 401, the image forming unit 102 includes a primary charging device intake fan 408, developing device intake fans 409Y, 409M, and 409C, and an image formation exhaust fan 410.

The primary charging device intake fan 408 supplies outside air for ventilation to the primary charging device 202K of the image forming station 200K. A primary charging device intake filter 411 is disposed on the upstream side of the primary charging device intake fan 408 to collect dust floating in the ambient air and to supply cleaned air to the primary charging device 202K.

The developing device intake fans 409Y, 409M, and 409C supply, to the developing devices 204Y, 204M, and 204C, outside air for cooling.

The image formation exhaust fan 410 exhausts the ozone emitted by the primary charging device 202K and pre-transfer charging device 219 due to corona discharge, from the image forming station 200K. In addition, the image formation exhaust fan 410 exhausts the heat emitted by each developing device 204 due to friction during rotational drive, from each image forming station 200. Moreover, the image formation exhaust fan 410 exhausts the heat retained inside through the toner recovery path 1210. Further, the image formation exhaust fan 410 exhausts a small amount of floating toner emitted in each process of toner image formation, from each image forming station 200. An image formation exhaust filter 412 is disposed on the upstream side of the image formation exhaust fan 410 to collect ozone and toner-containing dust discharged from each image forming station 200 and to exhaust the cleaned air to outside the image forming apparatus 101.

With the configuration of the image formation airflow 401 described above, ozone, heat, and dust emitted in the image formation process can be efficiently exhausted without being retained in each image forming station 200 and can be collected by the image formation exhaust filter 412.

As a result, it is possible to prevent the charging image defects such as uneven charging caused by ozone or dust adhering to the photosensitive drum 201 or the primary charging device 202, the development image defects caused by overheating of the toner and deterioration of its fluidity, the operation failures such as clogging of the toner conveyance path, and the transfer image defects caused by ozone or dust adhering to the pre-transfer charging device 219.

In this way, the image forming apparatus 101 that excels in high image quality, high stability, and long life can be provided. In addition, it is possible to provide the image forming apparatus 101 that reduces the amount of ozone and dust exhausted to the outside of the image forming apparatus 101, and thus excels in environment friendliness.

For the pre-fixing conveyance airflow 402, the inner periphery of the pre-fixing conveyance belts 217*a* and 217*b* are provided with a pre-fixing conveyance intake fan 413 (FIG. 4B) for suctioning the sheet S to the outer peripheral surface of the pre-fixing conveyance belts 217*a* and 217*b* via suction ports (not illustrated) provided in the pre-fixing conveyance belts 217*a* and 217*b*. The pre-fixing conveyance belts 217*a* and 217*b* according to the present exemplary embodiment are an example of a conveyance unit, and the pre-fixing conveyance intake fan 413 is an example of a first fan.

A total of the four pre-fixing conveyance intake fans 413 are provided, two on the front and rear sides for each one of the pre-fixing conveyance belts 217*a* and 217*b*. In this manner, the pre-fixing conveyance airflow 402 of the image forming unit 102 is configured by the pre-fixing conveyance intake fan 413.

The pre-fixing conveyance intake fan 413 is adjusted to have an optimum airflow rate, by a control circuit (not illustrated), depending on the material and shape of the sheet S to be conveyed. With this configuration, stable conveyance can be performed for a variety of materials without disturbing an unfixed toner image on the sheet S. Accordingly, the image forming apparatus 101 that excels in high image quality, high stability, and high functionality can be provided.

The pre-fixing conveyance intake fan 413 may suction heat, volatile organic compounds (VOCs), dust, and ultra fine particles (UFPs) emitted by the adjacent fixing unit 301. Thus, the pre-fixing conveyance airflow 402 originating from the pre-fixing conveyance intake fan 413 inside the image forming unit 102 collects VOCs, dust and UFPs with a fixing lower exhaust filter 422 inside the fixing conveyance unit 103 as described below, and exhausts the cleaned air to the outside of the image forming apparatus 101. With this configuration, it is possible to provide the image forming apparatus 101 that reduces the amount of VOCs, dust, and UFPs exhausted to the outside of the image forming apparatus 101, and thus excels in environment friendliness.

For the power supply airflow 403 the image forming unit 102 includes a power supply exhaust fan 415 that exhausts the heat emitted by a power supply board 414 to the outside of the image forming apparatus 101. Along with the exhaust by the power supply exhaust fan 415, outside air for cooling is supplied from a power supply intake port 416, and the power supply board 414 can be efficiently cooled. This configuration can prevent operation failure or malfunction of the image forming apparatus 101 caused by overheating of the power supply board 414 and a decrease in output. In this way, an image forming apparatus 101 that excels in high production, high stability, and long life can be provided.

For the fixing airflow 404, the fixing conveyance unit 103 includes a fixing exhaust heat fan 417, which includes fans 417*a*, 417*b*, and 417*c*, a fixing pressing intake fan 418, a fixing pressing exhaust fan 419, and a moisture exhaust fan 420. In the present exemplary embodiment, the fixing pressing exhaust fan 419 and the moisture exhaust fan 420 are examples of a second fan.

As illustrated in FIG. 4B, the fixing airflow 404 has a fixing airflow 404*a* for an upper part that is a heating side of the fixing unit 301 and has a fixing airflow 404*b* for a lower part that is a pressurizing side of the fixing unit 301. The fixing exhaust heat fans 417*a*, 417*b*, and 417*c* mainly exhausts heat emitted from the upper part, which is the heating side of the fixing unit 301, to the outside of the image forming apparatus 101. When the parts constituting the fixing unit 301 or a mold release agent (wax) contained in the toner are heated, VOCs, dust, UFPs, and the like may be emitted along with the heat. Thus, a fixing upper exhaust filter 421 for collecting VOCs, dust, UFPs, and the like from the fixing airflow 404*a* is disposed on the downstream side of the airflow generated by the fixing exhaust heat fans 417*a*, 417*b*, and 417*c*.

The fixing pressing intake fan 418 supplies outside air for the fixing airflow 404*b* for cooling to the lower part, which is the pressurizing side of the fixing unit 301. The fixing pressing exhaust fan 419 exhausts heat emitted from the lower part, which is the pressurizing side of the fixing unit 301, to the outside of the image forming apparatus 101. The moisture exhaust fan 420 exhausts water vapor emitted from the sheet S heated by the fixing unit 301 to the outside of the image forming apparatus 101.

On the downstream side of the airflow generated by the fixing pressing exhaust fan 419, the moisture exhaust fan 420, and the pre-fixing conveyance intake fan 413 described above, a fixing lower exhaust filter 422 is disposed to collect VOCs, dust, and UFPs emitted along with heat and water vapor.

With the configuration of the fixing airflow 404 described above, heat, moisture, VOCs, dust, and UFPs emitted in the heating process can be efficiently exhausted without being retained in the image forming apparatus 101. Thus, image defects and operation failures caused by overheating of the toner retained in the image forming apparatus 101, parts of each unit, and the like can be prevented.

In addition, overheating of the pressurizing side of the fixing unit 301 can prevent fixing image defects due to an excessive amount of heat given to the toner in the fixing process, and sheet conveyance defects such as fixing separation defects. Moreover, dew condensation on a conveyance guide caused by water vapor adhering thereto, and conveyance defects and image defects caused by condensed water droplets adhering to the sheet S being conveyed can be prevented. Further, it is possible to prevent operation failures and sheet conveyance failures caused by a mold release agent (wax) that has been vaporized by heating solidifying again and adhering to parts, or the like. Thus, the image forming apparatus 101 that excels in high image quality, high stability, and long life can be provided. Furthermore, it is possible to provide the image forming apparatus 101 that reduces the amount of VOCs, dust, and UFPs exhausted to the outside of the image forming apparatus 101, and thus excels in environment friendliness.

For the cooling unit airflow 405 the fixing conveyance unit 103 includes a cooling unit exhaust fan 423 for exhausting the heat emitted by the heat sink 303 disposed inside the cooling unit 302 to the outside of the image forming apparatus 101. The heat sink 303 of the cooling unit 302 is a heat exchanger that absorbs heat from the sheet S after fixing via the conveyance belt 302*a*, and releases the absorbed heat. With this configuration, the sheet S heated by the fixing unit 301 can be efficiently cooled, and the amount of heat dissipation from the sheet S in the downstream conveyance path can be reduced.

Thus, image defects and operation failures caused by overheating of the toner in the image forming unit 102 from the heat dissipation from the sheet S during double-sided image formation can be prevented. In addition, the toner image can be prevented from sticking between sheets S when a large number of deliverables are loaded in the post-processing apparatus. Thus, the image forming apparatus 101 that excels in high image quality and high stability can be provided.

For the power supply airflow 406 the fixing conveyance unit 103 includes power supply exhaust fans 425 and 426 that exhaust the heat emitted by the power supply board 424 to the outside. Along with the exhaust by the power supply exhaust fans 425 and 426, air for cooling is supplied from a power supply intake port 427, and the power supply board 424 can be efficiently cooled. This configuration can prevent operation failure or malfunction caused by overheating of the power supply board 424 and a decrease in output. Thus, the image forming apparatus 101 that excels in high productivity and high stability can be provided.

For the electrical component airflow 407, the fixing conveyance unit 103 includes an electrical component exhaust fan 1430 that exhausts the heat emitted by electrical component boards 428 and 429 to the outside. Along with the exhaust by the electrical component exhaust fan 1430, air for cooling is supplied from an electrical component intake port 1431, and the electrical component boards 428 and 429 can be efficiently cooled. This configuration can prevent operation failure or malfunction caused by overheating of the electrical component boards 428 and 429, and a decrease in output. Thus, the image forming apparatus 101 that excels in high productivity and high stability can be provided.

<Image Forming Apparatus: Airflow Balance>

Figure 5A:
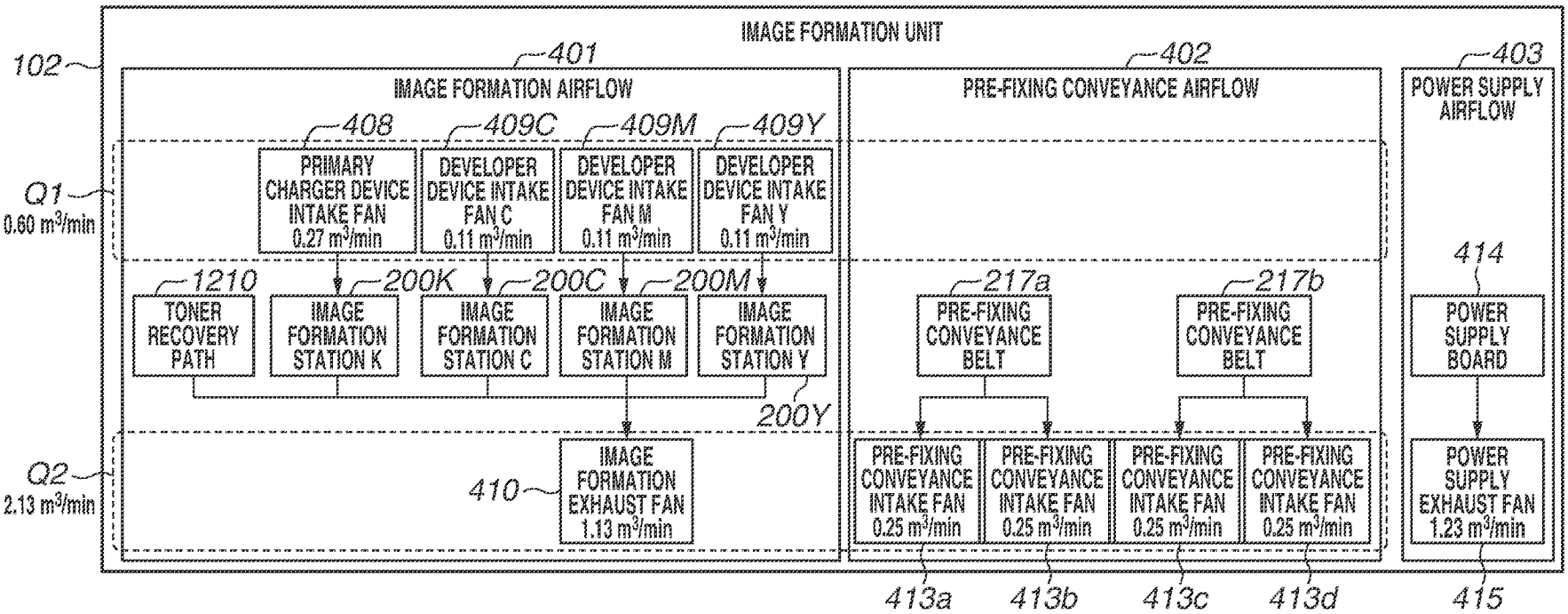
FIGS. 5A and 5B are block diagrams of a fan airflow rate of the image forming apparatus.
Figure 5B:
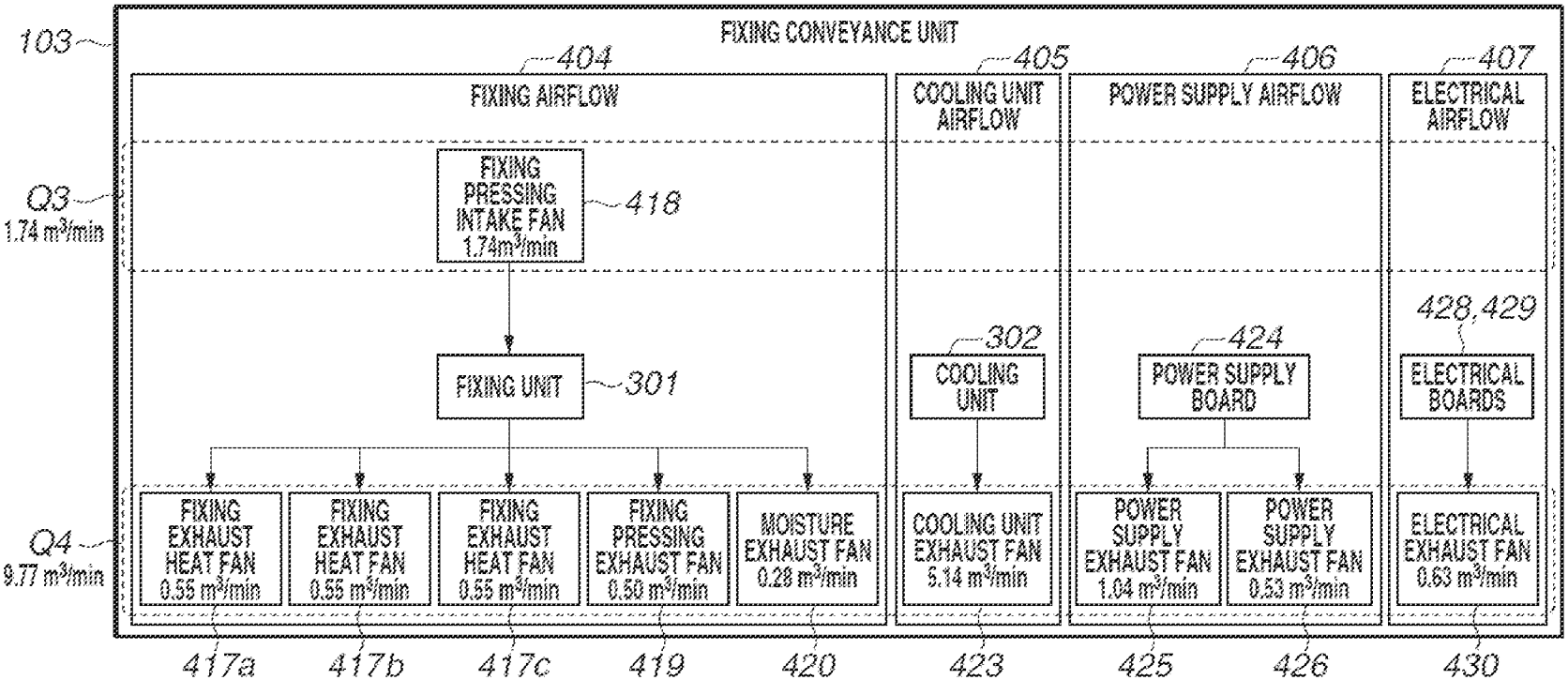

FIGS. 5A and 5B are a block diagram illustrating the airflow rates of the intake and exhaust fans in the image forming apparatus 101 according to the present exemplary embodiment. FIG. 5A illustrates the airflow rate of each fan of the image forming unit 102, and FIG. 5B illustrates the airflow rate of each fan of the fixing conveyance unit 103. The values illustrated in FIGS. 5A and 5B indicate, as an example, the airflow rate of each fan when image formation is performed on thick paper.

The dashed line in FIG. 5A indicates the total range of a total airflow rate Q1 of the intake fans and a total airflow rate Q2 of the exhaust fans acting inside the image forming unit 102 of the image forming apparatus 101. In FIG. 5A, the power supply airflow 403 includes an independent air path that is not connected to the inside of the image forming unit 102 and the fixing conveyance unit 103, and is configured to directly take in and exhaust air to the outside air. Consequently, the power supply airflow 403 is excluded from the total value because the power supply airflow 403 does not act on the airflow inside the image forming unit 102. Here, the intake fan is a fan for taking in air outside the image forming apparatus 101 into the inside thereof, and among the fans provided in the image forming unit 102, the primary charging device intake fan 408 and the three developing device intake fans 409C, 409M, and 409Y fall under the category. In addition, the exhaust fan is a fan for exhausting air inside the image forming apparatus 101 to the outside thereof, and among the fans provided in the image forming unit 102, the image formation exhaust fan 410 and four pre-fixing conveyance intake fans 413 fall under the category.

In the present exemplary embodiment, the total airflow rate Q2 of the exhaust fans is configured to be larger than the total airflow rate Q1 of the intake fans of the image forming unit 102 in the image forming apparatus 101 as follows.

$$Q1: 0.60\ m^3/min < Q2: 2.13\ m^3/min$$

With this configuration, the inside of the image forming unit 102 can be maintained at a relatively negative pressure more than the outside air. Accordingly, ozone and dust inside the image forming unit 102 can be prevented from leaking outside the image forming apparatus 101 through minute gaps such as the joint portions of the outer cover. Thus, in the image formation exhaust filter 412 provided at the airflow exhaust port of the image forming unit 102, ozone and dust are surely collected in the image forming apparatus 101, and the image forming apparatus 101 excellent in environment friendliness can be provided.

The dashed line in FIG. 5B illustrates the total range of a total airflow rate Q3 of the intake fans and a total airflow rate Q4 of the exhaust fans acting inside the fixing conveyance unit 103 of the image forming apparatus 101. In the present exemplary embodiment, the intake fan is a fan for taking in air outside the image forming apparatus 101 into the inside of the apparatus, and among the fans provided in the fixing conveyance unit 103, the fixing pressing intake fan 418 falls under the category.

In addition, the exhaust fan is a fan for exhausting air inside the image forming apparatus 101 to the outside thereof, and among the fans provided in the fixing conveyance unit 103, the three fixing exhaust heat fans 417*a*, 417*b*, and 417*c*, the fixing pressing exhaust fan 419, the moisture exhaust fan 420, the cooling unit exhaust fan 423, the power supply exhaust fans 425 and 426, and the electrical component exhaust fan 1430 fall under the category.

In the present exemplary embodiment, the total airflow rate Q4 of the exhaust fan is configured to be larger than the total airflow rate Q3 of the intake fans.

$$Q3: 1.74\ m^3/min < Q4: 9.77\ m^3/min$$

With this configuration, the inside of the fixing conveyance unit 103 can be maintained at a relatively negative pressure more than the outside air. Accordingly, VOCs, dust, and UFPs inside the fixing conveyance unit 103 can be prevented from leaking outside the image forming apparatus 101 through minute gaps such as the joint portions of the outer cover. Thus, in the fixing upper exhaust filter 421 provided on the upstream side of the airflow with respect to the airflow exhaust port of the fixing conveyance unit 103 and the fixing lower exhaust filter 422, collection of VOCs, dust, and UFPs in the image forming apparatus 101 is surely performed, and the image forming apparatus 101 excellent in environment friendliness can be provided.

Further, in the present exemplary embodiment, the differential airflow rate between the total airflow rate Q4 of the exhaust fans and the total airflow rate Q3 of the intake fans in the fixing conveyance unit 103 is configured to be larger than the differential airflow rate between the total airflow rate Q2 of the exhaust fans and the total airflow rate Q1 of the intake fans in the image forming unit 102.

$$(Q2-Q1): 1.53\ m^3/min < (Q4-Q3): 8.03\ m^3/min$$

With this configuration, the inside of the fixing conveyance unit 103 can be maintained at a relatively negative pressure more than the inside of the image forming unit 102. Thus, heat, VOCs, dust, UFPs, and water vapor emitted inside the fixing conveyance unit 103 can be prevented from flowing into the inside of the image forming unit 102 from the communicating section between the image forming unit 102 and the fixing conveyance unit 103. In other words, heat, VOCs, dust, UFPs, and water vapor, which tend to be generated in the vicinity of the fixing unit 301, can be prevented from flowing into the inside of the housing of the image forming unit 102, which is disposed adjacent to the fixing conveyance unit 103.

In this way, it is possible to prevent image defects and operation failures caused by the heat of the fixing unit 301 flowing into the image forming unit 102 to deteriorate the fluidity of toner, image defects, conveyance defects, and operation failures due to VOCs, dust, or UFPs flowing in and adhering to parts, and image defects and conveyance defects due to water vapor flowing in and dew condensation on parts, and the like.

As described above, the heat emitted inside the fixing conveyance unit 103 is efficiently exhausted from the airflow exhaust port of the fixing conveyance unit 103 without remaining inside the image forming unit 102, and VOCs, dust, and UFPs are surely collected in the fixing upper exhaust filter 421 and the fixing lower exhaust filter 422 provided at the exhaust port. Thus, the image forming apparatus 101 that excels in high image quality, high stability, and long life, and that is excellent in environment friendliness can be provided.

<Image Forming Unit 102: Pre-Fixing Conveyance Airflow 402>

Next, referring to FIGS. 6 to 8, the pre-fixing conveyance airflow 402 of the image forming unit 102 according to the present exemplary embodiment will be described.

Figure 6:
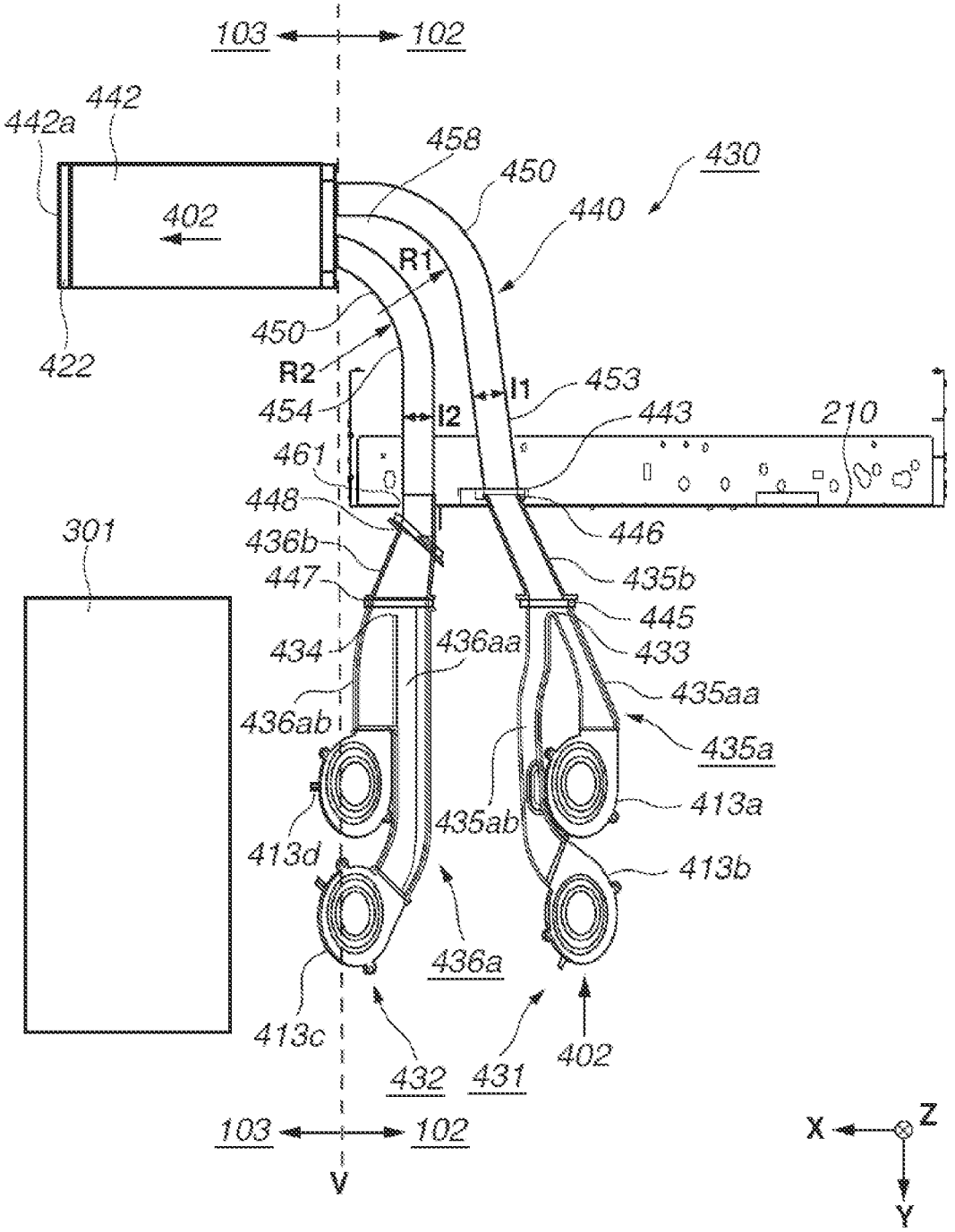
FIG. 6 is a diagram illustrating a duct unit indicating a pre-fixing conveyance airflow.
Figure 7:
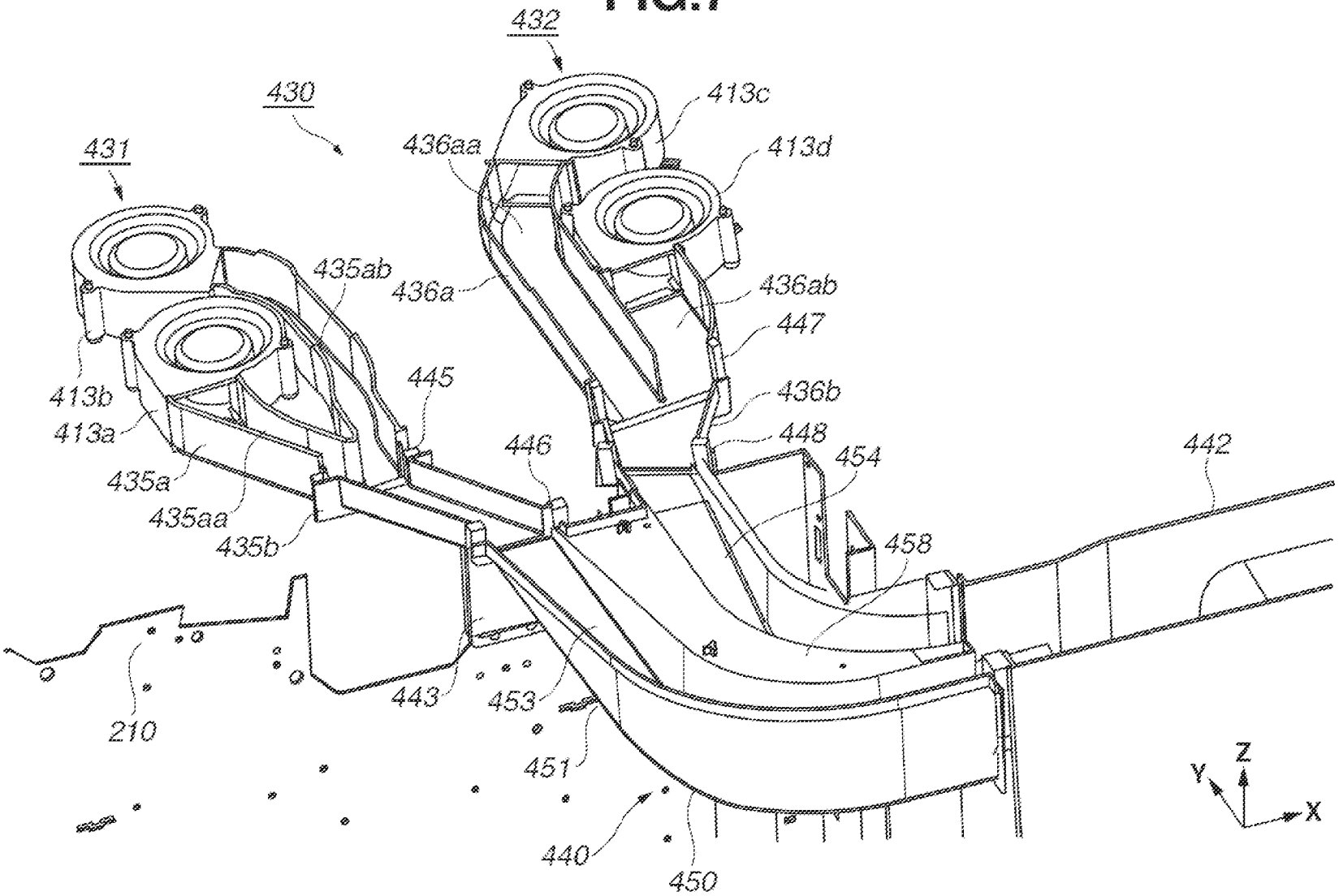
FIG. 7 is a perspective view of the pre-fixing conveyance airflow, seen from the rear side.

FIG. 6 is a cross-sectional view illustrating a duct unit forming the pre-fixing conveyance airflow 402. FIG. 7 is a perspective view illustrating a duct unit forming the pre-fixing conveyance airflow 402. FIG. 8 is a diagram illustrating joint portions of a first pre-fixing suction duct unit 431, a second pre-fixing suction duct unit 432, and a pre-fixing exhaust duct unit 430.

As illustrated in FIG. 6, the pre-fixing conveyance airflow 402 is formed by a pre-fixing exhaust duct unit 430 and a fixing exhaust duct unit 442.

The pre-fixing exhaust duct unit 430 has the first pre-fixing suction duct unit 431, the second pre-fixing suction duct unit 432, and the exhaust duct unit 440. The first pre-fixing suction duct unit 431 is provided with a pre-fixing conveyance intake fans 413*a* and 413*b* that take in air into this duct unit. In addition, the second pre-fixing suction duct unit 432 is provided with a pre-fixing conveyance intake fans 413*c* and 413*d* that take in air into this duct unit.

These pre-fixing conveyance intake fans 413*a* to 413*d* are, as described above, fans that are provided in the inner periphery of the pre-fixing conveyance belts 217*a* and 217*b*, and are for suctioning air in such a manner that the sheet S is suctioned to the outer peripheral surface of the pre-fixing conveyance belts 217*a* and 217*b* via suction ports (not illustrated) provided in the pre-fixing conveyance belts 217*a* and 217*b*. Here, the pre-fixing conveyance intake fans 413*a* and 413*b* are provided in the inner periphery of the pre-fixing conveyance belt 217*a*, and the pre-fixing conveyance intake fans 413*c* and 413*d* are provided in the inner periphery of the pre-fixing conveyance belt 217*b*. If the configuration is such that a sheet with unfixed toner can be suctioned and conveyed to the pre-fixing conveyance belts 217*a* and 217*b*, it is not always necessary to provide the pre-fixing conveyance intake fans 413*a* to 413*c* in the inner periphery of each belt. For example, the pre-fixing conveyance intake fans 413*a* to 413*c* may be provided outside the pre-fixing conveyance belts 217*a* and 217*b* and inside the first and second pre-fixing suction duct units 431 and 432, and only the intake ports may be provided in the inner periphery of the pre-fixing conveyance belts 217*a* and 217*b*. In the present exemplary embodiment, the pre-fixing conveyance intake fans 413*a* to 413*d* are an example of the intake fan. The pre-fixing conveyance intake fans 413*a* and 413*b* are an example of the first intake fan, and the pre-fixing conveyance intake fans 413*c* and 413*d* are an example of another intake fan.

In addition, the pre-fixing conveyance belt 217*a* is an example of the conveyance belt, and the pre-fixing conveyance belt 217*b* is an example of another conveyance belt.

The air suctioned in by the pre-fixing conveyance intake fan 413*a* passes through a first upstream section 435*aa*, and the air suctioned in by the pre-fixing conveyance intake fan 413*b* passes through a second upstream section 455*ab*.

Here, the first upstream section 435*aa* and the second upstream section 435*ab* are integrally formed by resin as a first upstream duct 435*a*, and the respective airflows flowing into the first upstream section 435*aa* and the second upstream section 435*ab* are merged by a first merging section 433.

In addition, the air suctioned in by the pre-fixing conveyance intake fan 413*c* passes through a third upstream section 436*aa*, and the air suctioned in by the pre-fixing conveyance intake fan 413*d* passes through a fourth upstream section 436*ab*. Here, the third upstream section 436*aa* and the fourth upstream section 436*ab* are integrally formed by resin as a second upstream duct 436*a*, and the respective airflows flowing into the third upstream section 436*aa* and the fourth upstream section 436*ab* are merged by a second merging section 434.

In addition, the first upstream duct 435*a* is connected to the first downstream duct 435*b* at a downstream side of the first merging section 433. Here, a sealing sheet 445 is provided between the first upstream duct 435*a* and the first downstream duct 435*b* to prevent air from leaking at the connecting section. In addition, in the first upstream duct 435*a*, the airflow through the first upstream section 435*aa* and the airflow through the second upstream section 435*ab* are configured to be consolidated into a single airflow at the first merging section 433 and then directed into the first downstream duct 435*b*. This reduces the number of joint portions of the duct between the first upstream duct 435*a* and the first downstream duct 435*b* and suppresses air leakage due to the joint portions.

In addition, the second upstream duct 436*a* is connected to the second downstream duct 436*b* on a downstream side of the second merging section 434. Here, a sealing sheet 447 is provided between the second upstream duct 436*a* and the second downstream duct 436*b* to prevent air from leaking at the connecting section. In addition, in the second upstream duct 436*a*, the airflow through the third upstream section 436*aa* and the airflow through the fourth upstream section 436*ab* are configured to be consolidated into a single airflow at the second merging section 434 and then directed into the second downstream duct 436*b*. This reduces the number of joint portions of the duct between the second upstream duct 436*a* and the second downstream duct 436*b* and suppresses air leakage due to the joint portions.

In addition, the airflow passing through the first downstream duct 435*b* is directed to a first pre-fixing exhaust duct 453 provided further downstream, and the airflow passing through the second downstream duct 436*b* is directed to a second pre-fixing exhaust duct 454.

Here, the first pre-fixing exhaust duct 453 and the second pre-fixing exhaust duct 454 are part of the exhaust duct unit 440 and are ducts for directing air from the image forming unit 102 to the fixing conveyance unit 103 and into the fixing exhaust duct unit 442 provided in the fixing conveyance unit 103 of the image forming apparatus 101. Thus, the exhaust duct unit 440 includes a partition 458 for separating the first pre-fixing exhaust duct 453 from the second pre-fixing exhaust duct 454.

In addition, the first pre-fixing exhaust duct 453, the second pre-fixing exhaust duct 454, and the partition 458 are integrally formed by resin as the exhaust duct unit 440.

Here, the above-described pre-fixing conveyance belt 217*a* is configured to be able to be pulled out from the image forming unit 102 toward the front side (arrow Y direction) of the image forming apparatus 101 at a time of the sheet removal when a sheet S conveyance abnormality (so-called jam) occurs or at a time of the maintenance of the unit. Thus, the first pre-fixing suction duct unit 431 provided inside the pre-fixing conveyance belt 217*a* is also configured to be able to be pulled out in the arrow Y direction.

Consequently, a pre-fixing exhaust duct support plate 443 is provided between the first pre-fixing suction duct unit 431 and the first pre-fixing exhaust duct 453 to prevent damage to the respective duct units when the units are inserted or removed with a strong force during maintenance. This pre-fixing exhaust duct support plate 443 prevents the first pre-fixing suction duct unit 431 and the first pre-fixing exhaust duct 453 from directly interfering with each other even when a unit supporting the pre-fixing conveyance belt 217*a* is inserted or removed with a strong force during maintenance. Here, a sealing sheet 446 is provided between the pre-fixing exhaust duct support plate 443 and the first downstream duct 435*b* of the first pre-fixing suction duct unit 431. This sealing sheet 446 can prevent air from leaking from the joint portions of each duct, even in a configuration where the ducts are dividable.

As illustrated in FIG. 2A, the pre-fixing conveyance belt 217*b* provided in the image forming unit 102 protrudes outward further (on the fixing conveyance unit 103 side) than the support frame (not illustrated) of the image forming unit 102 in order to stably convey the sheet S on which the unfixed toner is placed, to the fixing unit 301 provided in the fixing conveyance unit 103 that is a separate housing. Thus, as illustrated in FIG. 6, a part of the second pre-fixing suction duct unit 432 provided inside the pre-fixing conveyance belt 217*b* protrudes toward the fixing conveyance unit 103 at a boundary line V between the image forming unit 102 and the fixing conveyance unit 103.

The portion where this second pre-fixing suction duct unit 432 is provided is disposed at a position overlapping a support pillar (not illustrated) provided on the front side of the metal plate that constitutes the support frame of the image forming unit 102 in the arrow X direction. Thus, unlike the first pre-fixing suction duct unit 431, the second pre-fixing suction duct unit 432 is configured so as not to be pulled out from the front side (arrow Y direction) of the image forming unit 102.

Because of this configuration, when the maintenance of the second pre-fixing suction duct unit 432 is performed, the second pre-fixing suction duct unit 432 is removed from the left side (arrow X direction side) of the image forming unit 102. A sealing sheet 448 is also provided between the second pre-fixing suction duct unit 432 and the second pre-fixing exhaust duct 454 to prevent air from leaking from the gap between the ducts.

In this way, the second pre-fixing suction duct unit 432 is provided with a gap in the front-rear direction with respect to a rear side plate 210 in such a manner that the second pre-fixing suction duct unit 432 can be easily mounted to the image forming unit 102, although there is a concern that the second pre-fixing suction duct unit 432 may be difficult to maintain. In other words, the second pre-fixing suction duct unit 432 is configured to be located on the front side of the rear side plate 210. Here, the rear side plate 210 is a support sheet metal provided on the rear side of the support frame of the image forming unit 102 described above.

Thus, the rear side plate 210 is provided with an opening 461 for the duct through which the second pre-fixing exhaust duct 454 connected to the second pre-fixing suction duct unit 432 passes.

In addition, in order to prevent the sealing sheet 448 that seals between the second pre-fixing suction duct unit 432 and the second pre-fixing exhaust duct 454 from peeling off when the second pre-fixing suction duct unit 432 is mounted from the left direction (arrow X direction), the duct joint portion to which the sealing sheet 448 is attached is angled at an angle of 30 degrees with respect to the insertion/removal direction of the second pre-fixing suction duct unit 432.

Figure 8:
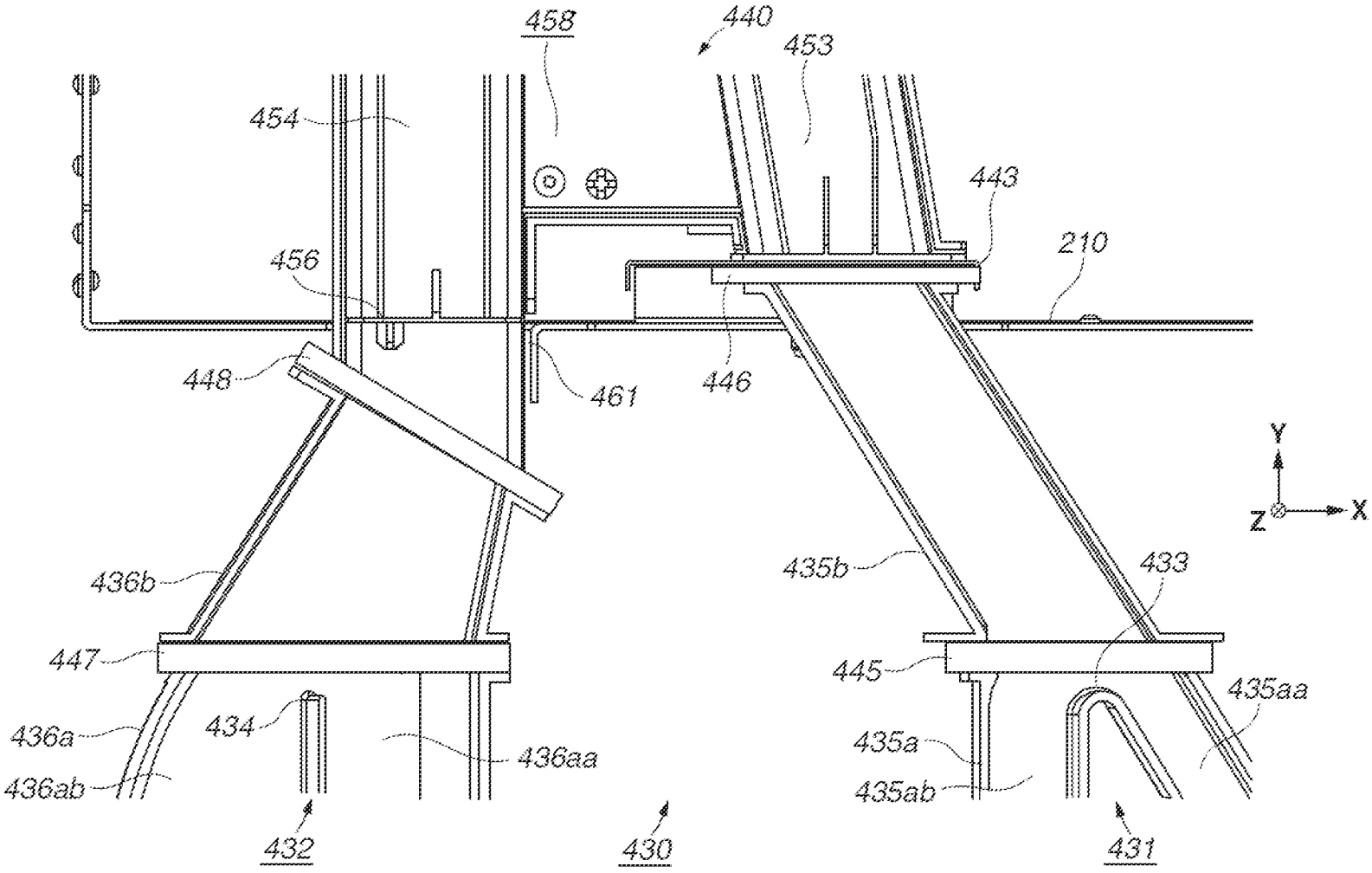
FIG. 8 is a diagram illustrating a joint portion of a first pre-fixing suction duct unit, a second pre-fixing suction duct unit, and a pre-fixing exhaust duct unit.

As illustrated in FIG. 8, the second pre-fixing exhaust duct 454 has a boss 456 that fits into a through-hole (not illustrated) provided in the rear side plate 210, and the boss 456 fits into the above-described through-hole to thereby prevent the position of the second pre-fixing exhaust duct 454 from being displaced when the second pre-fixing suction duct unit 432 is inserted or removed. Thus, the position of the second pre-fixing exhaust duct 454 is prevented from being displaced by the force applied when the second pre-fixing suction duct unit 432 is inserted or removed, and air leaks at the joint portion of the duct due to the displaced position are prevented.

Figure 9:
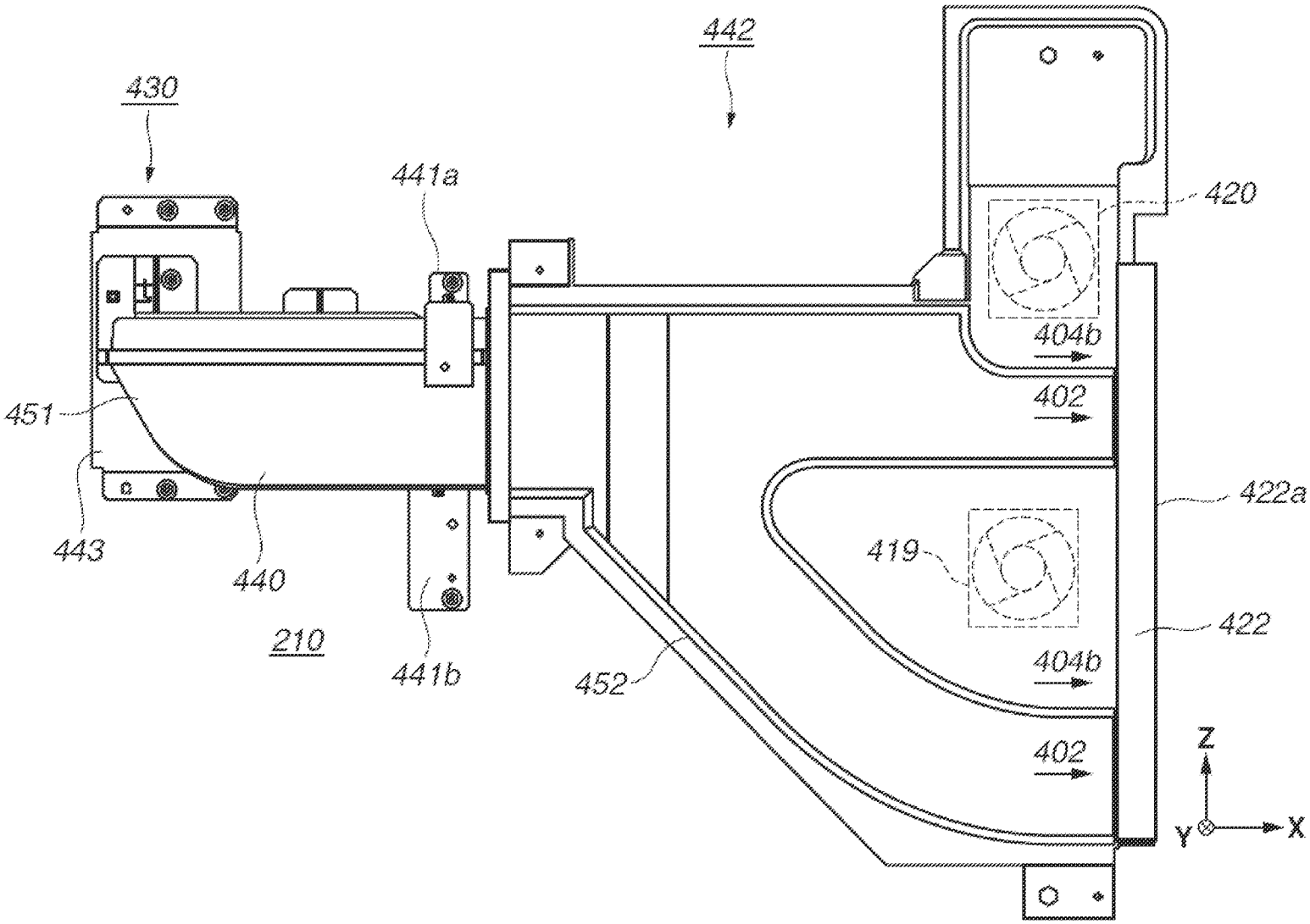
FIG. 9 is a diagram of a fixing exhaust duct unit, seen from the rear side.

Next, referring to FIG. 9, the connection configuration of the pre-fixing exhaust duct unit 430 and the fixing exhaust duct unit 442 will be described. FIG. 9 is a diagram of the fixing exhaust duct unit 442, as seen from the rear side. As illustrated in FIG. 9, the exhaust duct unit 440 is fixed to the rear side plate 210 by an upper support plate 441*a* and a lower support plate 441*b*.

The fixing exhaust duct unit 442 in the fixing conveyance unit 103 is a duct unit that consolidates the airflow 402 exhausted from the pre-fixing exhaust duct unit 430 in the image forming unit 102 and the airflows 404*b* formed by the above-described fixing pressing exhaust fan 419 and the moisture exhaust fan 420 in the fixing conveyance unit 103, and has the fixing lower exhaust filter 422 for collecting VOCs, dust, and UFPs, and the like contained with air in these three airflows. In addition, the fixing exhaust duct unit 442 includes a discharge port 442*a* for discharging the air that has passed through the fixing lower exhaust filter 422 into the sheet conveyance direction (arrow X direction) of the image forming apparatus 101. Here, a configuration where the discharge port 442*a* is located on the downstream side of the fixing lower exhaust filter 422 is described, but the fixing lower exhaust filter 422 may be disposed on the downstream side of the discharge port 442*a* as long as the air exhausted to the outside of the image forming apparatus 101 passes through the filter. In addition, the configuration may be such that the discharge port 442*a* and the fixing lower exhaust filter 422 are provided at a position away from each other.

In the present exemplary embodiment, the configuration of the duct directing the air taken in by the fixing pressing exhaust fan 419 and the moisture exhaust fan 420 to the fixing exhaust duct unit 442 is not illustrated. The air taken in from the fixing pressing exhaust fan 419 and the moisture exhaust fan 420 may be directly exhausted to the fixing exhaust duct unit 442, or another duct unit may be provided between the fixing pressing exhaust fan 419 and the moisture exhaust fan 420, and the fixing exhaust duct unit 442.

In the exhaust duct unit 440 of the pre-fixing exhaust duct unit 430, two airflows are formed by the air paths formed by the first pre-fixing exhaust duct 453 and the second pre-fixing exhaust duct 454.

Here, since a space can be secured even if a post-processing apparatus is installed on the side surface of the fixing exhaust duct unit 442 to which the pre-fixing exhaust duct unit 430 is connected, the exhaust direction is set to the left side of the main body and the fixing lower exhaust filter 422 is disposed on the left side of the fixing exhaust duct unit 442.

For this reason, it is necessary to bend the airflow by approximately 90 degrees in the duct in order to direct the air from the pre-fixing exhaust duct unit 430 to the fixing lower exhaust filter 422. In the present exemplary embodiment, the approximately 90 degrees indicates a range of 80 to 100 degrees. Generally, when a bend portion is provided in the duct, the pressure loss becomes high, but the pressure loss can be reduced by increasing R1 and R2 shapes of a duct bend portion 450 relative to inner widths 11 and 12 of the duct.

In the present exemplary embodiment, the inner widths 11 and 12 are set to 34 mm, and the R dimension (bend radius) is set to 80 mm, which is at least twice as large as the inner width. Next, in order to improve maintainability, an appropriate filter size is required from the viewpoint of the life of the filter. It is desirable that the cross-sectional area of the duct is neither enlarged nor reduced. However, from the viewpoint of space, it is difficult to secure a duct cross-sectional area of the same size as the filter in the first pre-fixing suction duct unit 431 and the second pre-fixing suction duct unit 432.

For this reason, it is necessary to enlarge the cross-sectional area of the duct between the exhaust duct unit 440 of the pre-fixing exhaust duct unit 430 and the fixing lower exhaust filter 422. In the present exemplary embodiment, the duct shape is such that the duct cross-sectional area gradually enlarges with respect to the most downstream fixing lower exhaust filter 422.

In addition, in the present exemplary embodiment, the filter is disposed in such a manner that the filter has a vertically long shape in the vertical direction (arrow Z direction) in order to reduce the size of the image forming apparatus 101 in the front-rear direction. Accordingly, the duct corresponding to this filter must be larger in the vertical direction than in the front-rear direction, and the method for enlarging the duct is important for this reason.

As described above, when the duct is bent, the pressure loss at the bend portion may increase, and thus the angle of a first vertical enlargement portion 451 starting from the upstream side of the duct bend portion 450 to the horizontal plane is 20 degrees or less, so that the enlargement angle is small. In addition, at a second vertical enlargement portion 452 downstream of the duct bend portion 450, the pressure loss of the entire duct is reduced by making the angle to the horizontal plane to be 45 degrees which is larger than the angle of the first vertical enlargement portion 451.

Although the duct can be enlarged only by the second enlargement portion 452, the enlargement angle exceeds 45 degrees and the pressure loss of the second enlargement portion 452 becomes too large in that case. However, unlike the present exemplary embodiment, in a case where it is possible to increase the size of the front-rear direction of the image forming apparatus 101, the first enlargement portion 451 may be configured in such a manner that the bend portion is 90 degrees. In this case, the angle may be in the same range as the angle of the second enlargement portion 452. If the distance in the front-rear direction cannot be secured widely, it is desirable to make the angle of the second enlargement portion 452 to be 45 degrees or less while making the angle of the first enlargement portion 451 smaller than the angle of the second enlargement portion 452.

In this way, by connecting the pre-fixing exhaust duct unit 430 to the fixing exhaust duct unit 442, air to be suctioned in the image forming unit 102 of the image forming apparatus 101 is passed through the fixing lower exhaust filter 422 provided in the fixing conveyance unit 103, which is a different housing from the image forming unit 102, and the air can be exhausted. As a result, in the image forming apparatus 101 having a plurality of housings, the airflow for exhausting air in the vicinity of the fixing unit 301 can be consolidated into one. Accordingly, since it is possible to collect VOCs, UFPs, and the like generated in the vicinity of the fixing unit 301 with a single filter, workability during maintenance such as filter replacement can be improved. In the present exemplary embodiment, the configuration with one filter is described, but a configuration with a plurality of filters is also possible. For example, two filters may be integrally replaceable as a filter unit, or two filters may be replaceable at different replacement timings. In addition, a filter may be provided for each of the airflow exhausted from the pre-fixing exhaust duct unit 430 and the airflow formed by the fixing pressing exhaust fan 419 and the moisture exhaust fan 420. Even in this case, by providing the filter at a position corresponding to a common exhaust port, the workability at the time of filter replacement can be improved.

In the present exemplary embodiment, the first pre-fixing suction duct unit 431 and the second pre-fixing suction duct unit 432 are provided because the pre-fixing conveyance belts 217*a* and 217*b* are provided. However, if the length of the conveyance path from the secondary transfer nip to the fixing nip of the fixing unit 301 is short, only the pre-fixing conveyance belt 217*a* and the first pre-fixing suction duct unit 431 may be provided.

Next, a second exemplary embodiment will be described with reference to FIG. 10. In the second exemplary embodiment, the configuration of the housing of the image forming apparatus 101 is different from the configuration of the housing of the first exemplary embodiment.

Figure 10:
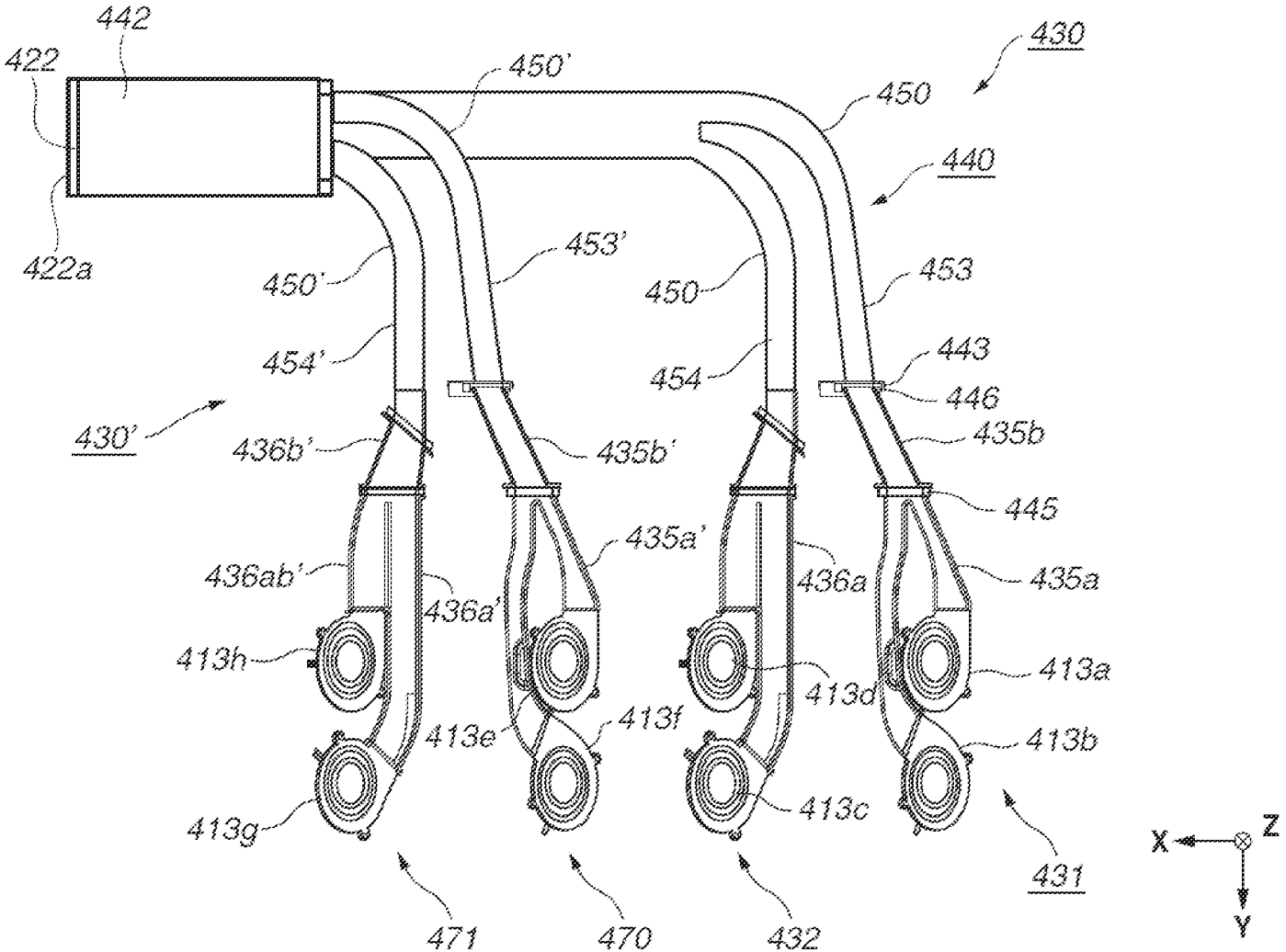
FIG. 10 is a diagram illustrating a duct unit indicating a pre-fixing conveyance airflow according to a second exemplary embodiment.

FIG. 10 is a schematic cross-sectional view of pre-fixing exhaust duct units 430 and 430' according to the second exemplary embodiment.

In the second exemplary embodiment, a configuration will be described in which the first and second pre-fixing suction duct units 431 and 432 and the fixing unit 301 are distant, and third and fourth pre-fixing suction duct units 470 and 471 are further included. Since the configurations of the pre-fixing exhaust duct unit 430 and the fixing exhaust duct unit 442 according to the second exemplary embodiment are the same as the configurations of the pre-fixing exhaust duct unit 430 and the fixing exhaust duct unit 442 according to the first exemplary embodiment, the descriptions thereof are omitted.

Even in a case where the third and fourth pre-fixing suction duct units 470 and 471 are provided in the image forming apparatus 101, which is the first housing, downstream of the first and second pre-fixing suction duct units 431 and 432, it is also necessary to provide pre-fixing conveyance intake fans 413*e* to 413*h* in the same manner as the pre-fixing conveyance intake fans 413*a* to 413*d*. Consequently, there is a possibility that VOCs, dust, and the like may be suctioned in by the third and fourth pre-fixing suction duct units 470 and 471 from the fixing unit 301 provided in the fixing conveyance unit 103. For this reason, exhaust ducts also needs to be provided in the third and fourth pre-fixing suction duct units 470 and 471 and connected to the fixing exhaust duct unit 442 in the same manner as the first and second pre-fixing suction duct units 431 and 432. The detailed configuration of the third and fourth pre-fixing suction duct units 470 and 471 is similar to the configuration of the first and second pre-fixing suction duct units 431 and 432 described above, and therefore the explanations thereof are omitted.

In this case, it is desirable to merge the airflows of the first and second pre-fixing suction duct units 431 and 432 and then merge the airflows of the third and fourth pre-fixing suction duct units 470 and 471, respectively. In this way, by merging the exhaust port of one duct unit with that of another duct unit at a time, air leakage can be prevented without complicating the shape of the merging section.

In addition, when merging with the fixing exhaust duct unit 442, it is necessary to bend the duct direction by approximately 90 degrees as in the first and second pre-fixing suction duct units, and thus it is desirable to increase the R dimension with respect to the inner width of the duct to reduce the pressure loss. If possible, it is appropriate to make the R dimension at least twice as large as the inner width. Moreover, when enlarging the vertical direction of the duct, an angle of approximately 20 degrees, which is smaller than the enlargement angle of 45 degrees of the fixing exhaust duct unit 442, is desirable, as is the case with the pre-fixing exhaust duct unit 430. The pressure loss can be suppressed by decreasing the enlargement angle of the bend portion by 90 degrees.

In addition, the third and fourth pre-fixing suction duct units 470 and 471 described in the second exemplary embodiment may be provided on the upstream side of the fixing unit 301 in the fixing conveyance unit 103.

In this way, by connecting the pre-fixing exhaust duct units 430 and 430' to the fixing exhaust duct unit 442, air to be suctioned in the image forming unit 102 of the image forming apparatus 101 is passed through the fixing lower exhaust filter 422 provided in the fixing conveyance unit 103, which is a different housing from the image forming unit 102, and the air can be exhausted. As a result, in the image forming apparatus 101 having a plurality of housings, the airflow for exhausting air in the vicinity of the fixing unit 301 can be consolidated into one. Accordingly, since it is possible to collect VOCs, UFPs, and the like generated in the vicinity of the fixing unit 301 with a single filter, workability at a time of maintenance such as filter replacement can be improved.

According to the exemplary embodiments described above, in an image forming apparatus having a plurality of housings, maintainability at the time of filter replacement can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-207101, filed Dec. 14, 2020, which is hereby incorporated by reference herein in its entirety.

What is claimed is:

1. An image forming apparatus having a first housing that includes an image forming unit configured to form a toner image on a sheet, and a second housing provided on a downstream side with respect to the first housing in a sheet conveyance direction and that includes a fixing unit configured to fix the toner image formed by the image forming unit to the sheet, the image forming apparatus comprising:

a conveyance belt provided in the first housing and configured to convey the sheet on which the toner image is formed by the image forming unit to the fixing unit;

a first intake fan configured to take in air so as to suck the sheet to an outer peripheral surface of the conveyance belt;

a first duct unit provided in the first housing and configured to guide air taken in by the first intake fan to a rear of a rear side plate arranged in the first housing;

a second duct unit provided in the first housing, wherein the second duct unit is used for guiding the air in the rear of the rear side plate to the second housing;

a second intake fan provided in the second housing and configured to take in air in a vicinity of the fixing unit;

a third duct unit provided in the second housing and configured to exhaust the air from the second duct unit and the air taken in by the second intake fan via an exhaust port; and a filter arranged to the third duct unit and through which the air exhausted from the exhaust port to outside of the image forming apparatus passes.

2. The image forming apparatus according to claim 1, wherein the first intake fan is provided in an inner periphery of the conveyance belt and takes in air from a plurality of intake ports formed in the conveyance belt to thereby suction the sheet to the outer peripheral surface of the conveyance belt.

3. The image forming apparatus according to claim 1, further comprising:

another conveyance belt provided on a downstream side of the conveyance belt in the sheet conveyance direction and including a plurality of intake ports; and another intake fan provided in an inner periphery in the other conveyance belt and takes in air so as to suction the sheet to an outer periphery of the other conveyance belt.

4. The image forming apparatus according to claim 1, wherein the third duct unit forms an airflow for sending air from an upstream side to a downstream side in the sheet conveyance direction of the image forming apparatus.

5. The image forming apparatus according to claim 1, wherein the third duct unit includes a cross-sectional area on a downstream side of an airflow of the third duct unit that is larger than a cross-sectional area on an upstream side of the airflow.

6. The image forming apparatus according to claim 1, wherein a negative pressure of an inside of the second housing is greater than a negative pressure of an inside of the first housing.

* * * * *